US008890070B2

(12) United States Patent
Fukada

(10) Patent No.: US 8,890,070 B2
(45) Date of Patent: Nov. 18, 2014

(54) OBJECT NEUTRALIZATION WITH FLEXIBLE DISCHARGE ELECTRODE

(75) Inventor: Yoshinari Fukada, Tokyo (JP)

(73) Assignee: Koganei Corporation, Tokyo (JP)

( * ) Notice: Subject to any disclaimer, the term of this patent is extended or adjusted under 35 U.S.C. 154(b) by 0 days.

(21) Appl. No.: 13/990,581

(22) PCT Filed: Aug. 29, 2011

(86) PCT No.: PCT/JP2011/069472

§ 371 (c)(1),
(2), (4) Date: May 30, 2013

(87) PCT Pub. No.: WO2012/090550

PCT Pub. Date: Jul. 5, 2012

(65) Prior Publication Data

US 2013/0299717 A1 Nov. 14, 2013

(30) Foreign Application Priority Data

Dec. 28, 2010 (JP) ..... 2010-292022

(51) Int. Cl.

| | |
|---|---|
| ***H01T 19/00*** | (2006.01) |
| ***H01J 27/08*** | (2006.01) |
| ***F24F 3/16*** | (2006.01) |
| ***H01T 23/00*** | (2006.01) |

(52) U.S. Cl.

CPC ..... *H01J 27/08* (2013.01); *F24F 3/166* (2013.01); *H01T 19/00* (2013.01); *H01T 23/00* (2013.01)

USPC ..... 250/324; 250/326; 361/230; 361/233

(58) Field of Classification Search

CPC ..... H01T 23/00; H01T 19/00; H01T 19/04; H05F 3/04; A61L 9/22; A61L 2209/212; A61L 2/14; F24F 2003/1682; F24F 3/166; F24F 2003/1635; F24F 2003/1671; F24F 2003/1685

USPC ..... 250/324, 325, 326; 361/213, 233, 230; 324/355

See application file for complete search history.

(56) References Cited

U.S. PATENT DOCUMENTS 3,146,385 A * 8/1964 Carlson ..... 361/225
3,254,215 A * 5/1966 Oliphant ..... 250/325

(Continued)

FOREIGN PATENT DOCUMENTS

JP 5662268 A 5/1981
JP 4-135937 U 12/1992

(Continued)

OTHER PUBLICATIONS

International Search Report for PCT/JP2011/069472 dated Nov. 7, 2011.

*Primary Examiner* — Brooke Purinton

(74) *Attorney, Agent, or Firm* — McCormick, Paulding & Huber LLP

(57) ABSTRACT

In an ion generator, a flexible discharge electrode 44 composed of one wire is provided to a base 43, and a turning motion of a free end 44*b* of the discharge electrode 44 about a fixed end 44*a* of the discharge electrode 44 is performed by repulsive force of a corona discharge generated by supplying a high voltage to the fixed end 44*a*. Therefore, in comparison with a discharge electrode composed of a bundle of thin wires, it is possible to significantly reduce dust emission from the free end 44*b* of the discharge electrode 44, and to further improve the ion generator 30 in maintenance interval. Since the discharge electrode 44 is compose of one wire, it is possible to reduce the discharge electrode 44 in size, easily observe the state of the discharge electrode 44, and simplify its maintenance. Since the discharge electrode 44 performs a turning motion, it is possible to transport the generated air ions EI to a wide area of a packaging film 10, and to enhance ionizing efficiency.

6 Claims, 11 Drawing Sheets

(56) References Cited

U.S. PATENT DOCUMENTS

| | | | | | |
|---|---|---|---|---|---|
| 3,483,374 | A | * | 12/1969 | Erben | 250/324 |
| 3,649,830 | A | * | 3/1972 | Sato et al. | 250/326 |
| 3,655,966 | A | * | 4/1972 | Takimoto et al. | 250/324 |
| 3,729,649 | A | * | 4/1973 | La Chappelle et al. | 361/225 |
| 4,107,755 | A | * | 8/1978 | Kiefer | 361/220 |
| 4,227,235 | A | * | 10/1980 | Bishop | 361/230 |
| 4,334,104 | A | | 6/1982 | Bettarini et al. | |
| 4,344,104 | A | | 8/1982 | Habets et al. | |
| 4,363,072 | A | * | 12/1982 | Coggins | 361/231 |
| 4,467,200 | A | * | 8/1984 | Kalwar et al. | 250/324 |
| 4,507,373 | A | * | 3/1985 | Tsilibes | 430/31 |
| 4,772,788 | A | * | 9/1988 | Tsutsui et al. | 250/324 |
| 5,038,036 | A | * | 8/1991 | Kouguchi et al. | 250/324 |
| 5,650,203 | A | * | 7/1997 | Gehlke | 250/423 R |
| 7,897,118 | B2 | * | 3/2011 | Taylor et al. | 422/186 |

FOREIGN PATENT DOCUMENTS

| | | | |
|---|---|---|---|
| JP | 9-22770 | A | 1/1997 |
| JP | 2006049227 | A | 2/2006 |
| JP | 2008034220 | A | 2/2008 |

* cited by examiner

OBJECT NEUTRALIZATION WITH FLEXIBLE DISCHARGE ELECTRODE

CROSS REFERENCE TO RELATED APPLICATIONS

This application claims the priority of PCT Application No. PCT/JP2011/069472, filed on Aug. 29, 2011 and Japanese Patent Application No. 2010-292022 filed on Dec. 28, 2010, the disclosures of which are incorporated herein by reference in their entirety.

BACKGROUND OF THE INVENTION

TECHNICAL FIELD

The present invention relates to an ion generator for generating air ions which are used for neutralizing and eliminating static electricity from an electrically-charged object such as for example a jig for assembling electronic parts, and a packaging film made of plastic material.

PRIOR ART

When a packaging film made of plastic material, a jig for assembling electronic parts, or the like is electrically charged, since the electronic parts may be broken by static electricity, or dusts and the like may be attached to those objects by static electricity, their assembling workability and packaging workability tend to be reduced. Therefore, in order to prevent their workability from being reduced by static electricity or to improve yield rate, an ion generator also referred to as an ionizer or an ion generator is used.

The ion generator is an apparatus for generating positive or negative air ions to electrically neutralize and eliminate static electricity by supplying the air ions to an electrically-charged section. The ion generator is provided with an electrode such as a discharge needle to which a high voltage is applied, and an alternating voltage or a pulse-like direct voltage of several kilovolts (for example, 7 kilovolts) or higher is applied to this electrode. When the high voltage is applied to the electrode, a corona discharge is generated from the electrode, and air around the electrode is ionized by this corona discharge.

For example, techniques disclosed in Japanese Patent Application Publication No. 2008-034220 are known an ion generator such as this. In the techniques disclosed in Japanese Patent Application Publication No. 2008-034220, a bundle electrode composed of thin wires bundled like a brush are used as an electrode. A high voltage is applied to the bundle electrode from a high voltage supply, and each thin wire of the bundle electrode is electrified by application of the high voltage. Then, because of electrification of the thin wires, the thin wires repel one another, the distal end portion of the bundle electrode is expanded radially, and the corona discharge is generated in this state. In this manner, in the techniques described in Japanese Patent Application Publication No. 2008-034220, air ions are generated in a large area to improve ionizing efficiency while downsizing this apparatus by using the bundle electrode.

SUMMARY OF THE INVENTION

Problems to be Solved by the Invention

However, according to the techniques disclosed in the above Japanese Patent Application Publication No. 2008-034220, for example, since a bundle electrode is composed of 100 ultrafine thin wires made of stainless steel and bundled like a brush, this apparatus encounters such a problem that dust emission from the thin wires is caused along with corona discharge. More specifically, the amount of dust emission to the outside is increased with increase in the number of the bundled thin wires. And dusts attached to the thin wires reduces the generation amount of air ions (ionizing efficiency is lowered).

Furthermore, in the bundled thin wires of this electrode, thin wires as its central part largely differ in bending deformation from thin wires as its outer peripheral part. More specifically, when the diameter of the distal end portion of the bundle electrode is radially expanded at the time of corona discharge, the thin wires of the central part are approximately straight and do not undergo bending deformation almost at all, while the thin wires as the outer peripheral part largely undergo bending deformation (for example, bent at a right angle). Therefore, since the thin wires as the outer peripheral part are easily broken (worn), and it is necessary to frequently observe the state of the bundle electrode, thereby causing complicated maintenance.

It is an object of the present invention to provide an ion generator simplified in maintenance and improved in ionizing efficiency.

Means for Solving the Problems

An ion generator according to the present invention comprises a flexible discharge electrode which is composed of one wire, and which has a fixed end and a free end; wherein repulsive force of a corona discharge generated by supplying a high voltage to the fixed end causes the free end side to carry out a turning motion around the fixed end.

The ion generator according to the present invention further comprises a turning-motion control member for controlling a turning motion of the discharge electrode.

In the ion generator according to the present invention, the discharge electrode is set to 100 micrometers or less in diameter size.

In the ion generator according to the present invention, the discharge electrode is formed of titanium alloy.

Effects of the Invention

Since the ion generator according to the present invention comprises a flexible discharge electrode composed of one wire, and a turning motion of the free end of the discharge electrode about the fixed end is performed by repulsive force of a corona discharge generated by supplying a high voltage to the fixed end, in comparison with a bundle electrode composed of thin wires, dust emission from the free end of the discharge electrode can be significantly reduced, and this apparatus can be further enhanced in maintenance interval. Since the discharge electrode is composed of one wire, the downsized ion generator can be realized, the state of the discharge electrode can be easily observed, and its maintenance can be simplified. Since the discharge electrode performs a turning motion, the generated air ions can be transported to a wide area of an object to be electrically neutralized, and ionizing efficiency can be improved.

Since the ion generator according to the present invention further comprises a turning-motion control member for controlling a turning motion of the discharge electrode, the side of a delivery area to which the generated air ions are carried can be arbitrarily controlled in accordance with, for example, the shape of the object to be electrically neutralized.

In the ion generator according to the present invention, since the discharge electrode is set to 100 micrometers or less in diameter, the discharge electrode has sufficient flexibility, and the generated air ions can be transported to a wide area.

In the ion generator according to the present invention, since the discharge electrode is formed of titanium alloy, in comparison with for example tungsten alloy, dust emission can be reduced while ensuring high strength, and this apparatus can be further enhanced in maintenance interval.

DESCRIPTION OF THE PREFERRED EMBODIMENTS

Hereinafter, the first embodiment of the present invention will be explained in detail with reference to the drawings.

Figure 1:
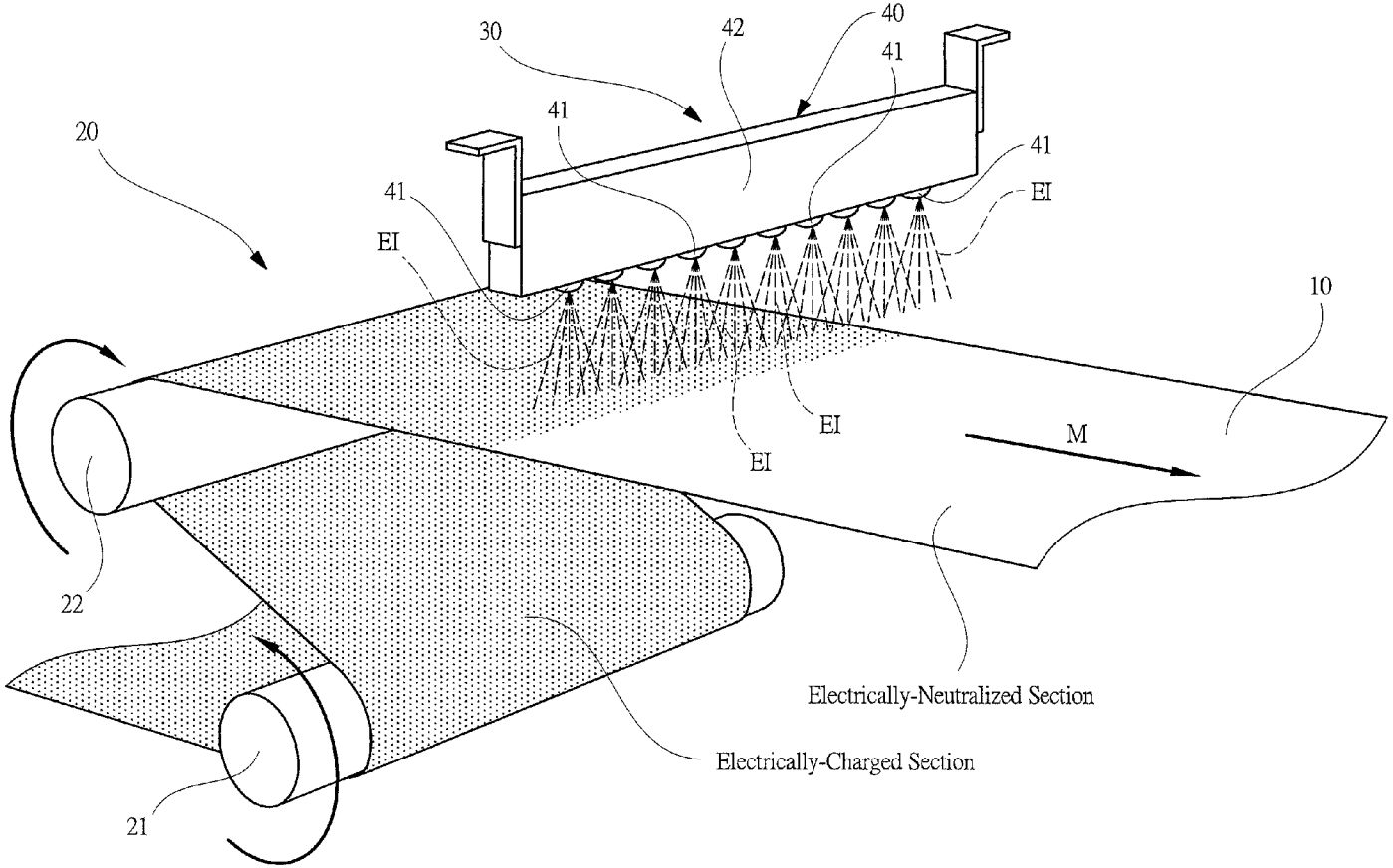
FIG. 1 is an explanatory diagram explaining one application case of an ion generator according to the present invention.
Figure 2:
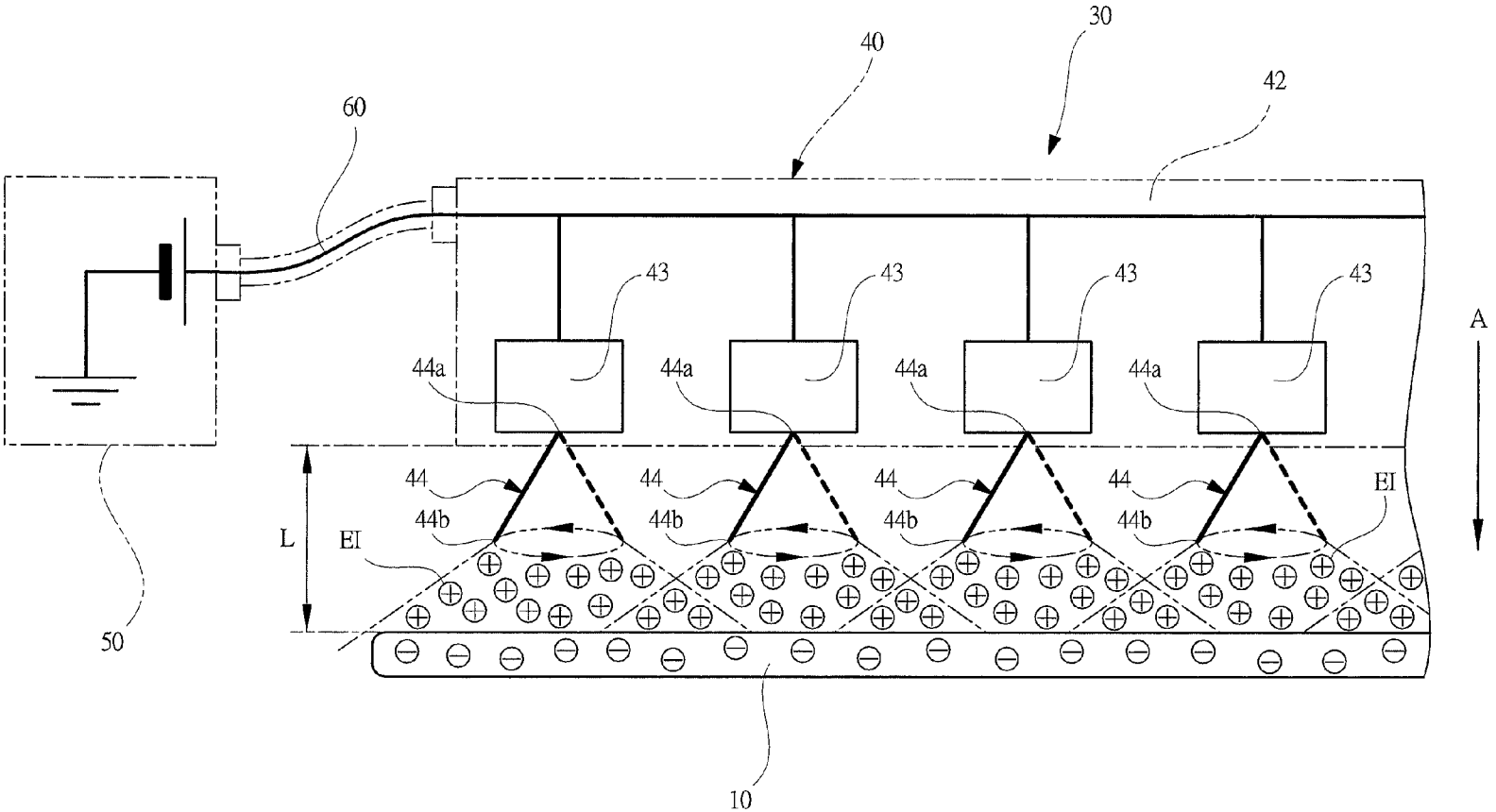
FIG. 2 is an explanatory diagram explaining the structure of the ion generator according to the first embodiment.
Figure 3:
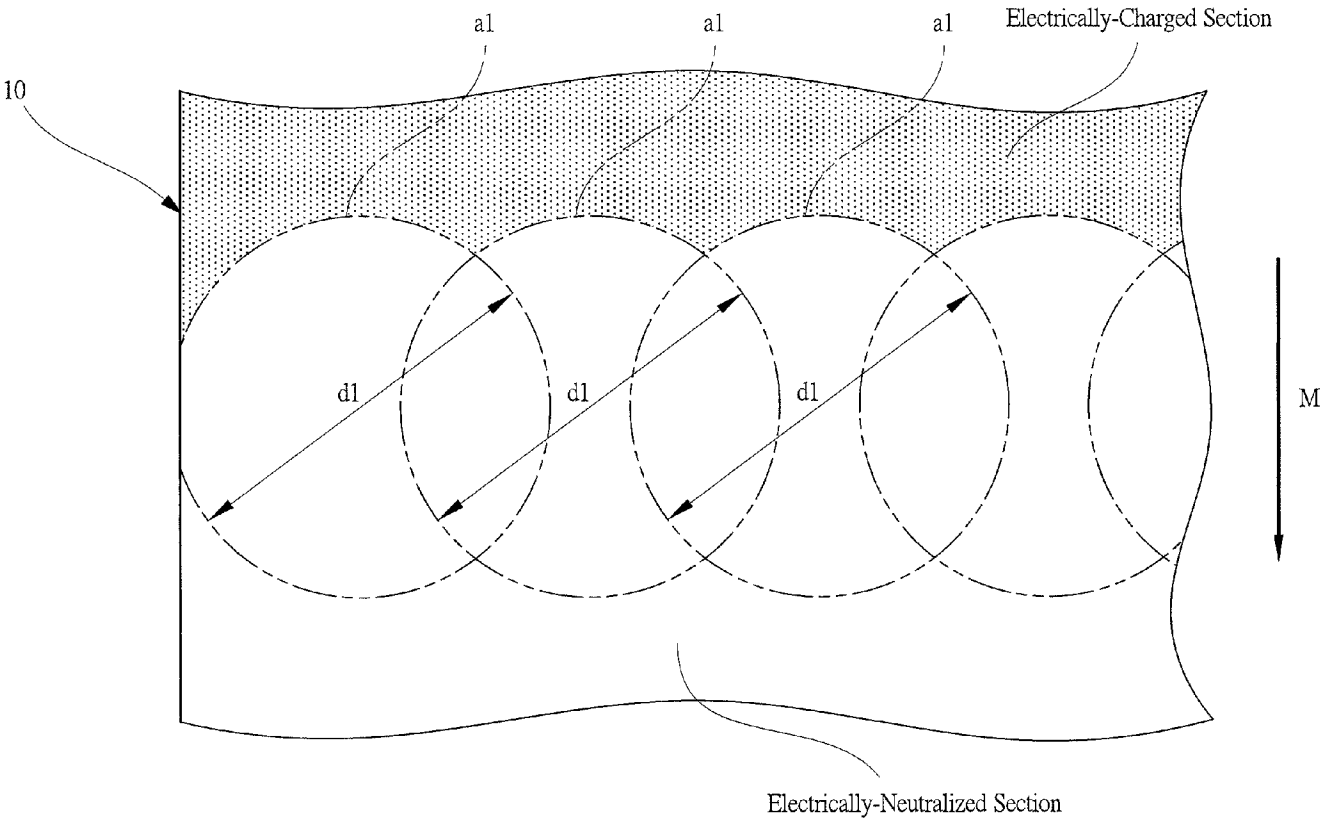
FIG. 3 is an A-arrow diagram explaining the size of a delivery area to which air ions are carried, in the ion generator shown in FIG. 2.

FIG. 1 is an explanatory diagram explaining one application case of an ion generator according to the present invention, FIG. 2 is an explanatory diagram explaining the structure of the ion generator according to the first embodiment, and FIG. 3 is an A-arrow diagram explaining the size of a delivery area to which air ions are carried, in the ion generator shown in FIG. 2.

FIG. 1 shows a case in which an ion generator 30 is applied to a film supplying apparatus 20 which supplies a packaging film (object) 10. The ion generator 30 is used for electrically neutralizing and eliminating static electricity from the packaging film 10 as an object to be electrically neutralized.

As shown in FIGS. 1 and 2, the ion generator 30 is provided with: a device main body 40 which generates air ions "EI"; a power-supply unit 50 which supplies a high voltage of about 5 kilovolts to the device main body 40; and a power-supply cable 60 which has a first-end side electrically connected to the power-supply unit 50, and a second-end side electrically connected to the device main body 40.

Additionally, although the power-supply unit 50 shown in FIG. 2 is configured to supply a positive high voltage, it may supply a negative high voltage. Furthermore, both a positive high-voltage power-supply unit and a negative high-voltage power-supply unit may be prepared so as to supply these high voltages to respective device main bodies 40.

The device main body 40 is a so-called bar type ionizer, and is mounted to a predetermined portion of a supporting frame (not shown) forming the film supplying apparatus 20, and located so as to face the moving packaging film 10. The device main body 40 is configured to generate a corona discharge by application of a high voltage from the power-supply unit 50, so that surrounding air is ionized by the corona discharge, and to generate positive or negative air ions "EI". Then, the generated air ions "EI" are sprayed toward the packaging film 10.

The thin sheet-shaped packaging film 10 is made of plastic material, and its distal-end side is fed in the direction of an arrow "M" by rotary drive of a pair of roller members 21 and 22 in the directions of arrows in the drawing. In this process, the packaging film 10 is electrostatically charged when the film is brought into contact with and then separated from the roller members 21 and 22. And, in order to immediately electrically neutralize and eliminate the static electricity, and to prevent dusts and the like from being attached to this film, the packaging film 10 is passed through the device main body 40 just after passing through the roller members 21 and 22.

The device main body 40 has a plurality of discharge nozzles 41, and the discharge nozzles 41 are arranged at regular intervals along the longitudinal direction of the device main body 40. The air ions "EI" are sprayed from each of the discharge nozzles 41 toward the packaging film 10. The air ions "EI" sprayed from the discharge nozzles 41 reach the packaging film 10, and electrically neutralize and eliminate the static electricity (shaded area in the drawing). In this manner, the static electricity can be eliminated from the packaging film 10 when passing through the device main body 40.

In this case, as shown in FIG. 1, the device main body 40 is disposed so that its longitudinal direction becomes parallel to the width direction of the packaging film 10 (i.e., direction orthogonal to the direction of the arrow "M"). However, for example, if the packaging film 10 is small in width, the device main body 40 may be disposed so that its longitudinal direction becomes parallel to the feeding direction of the packaging film 10 (i.e., direction of the arrow "M"). In this case, since the air ions "EI" can be transported to the electrically-charged portion of the packaging film 10 for a long period of time, electrical-neutralization time can be increased correspondingly, so that electrical neutralization is efficiently carried out.

Hereinafter, explanation will be given on the assumption that the packaging film 10 is electrically charged with negative static electricity (minus), and positive (or plus) air ions "EI" which are used to electrically neutralize the static electricity, are sprayed from the discharge nozzles 41.

The device main body 40 forming the ion generator 30 has a casing 42 formed into an approximately rectangular parallelepiped shape. In this casing 42, a plurality of bases 43 is provided at approximately regular intervals along its longitudinal direction. Each of the bases 43 is formed into an approximately cylindrical shape by using resin material such as for example plastic, and second-end-side terminals (not shown) branched from the power-supply cable 60 are inserted into the upper ends of the bases 43 in the drawing.

Fixed ends (base ends) 44*a* of the discharge electrodes 44 which form the discharge nozzles 41 are respectively inserted into lower and center portions of the bases 43 in the drawing. The discharge electrodes 44 are provided so as to correspond to the respective bases 43, and the fixed ends 44*a* of the discharge electrodes 44 are respectively electrically connected to the other end terminals of the power-supply cable 60 in the bases 43. The discharge electrodes 44 are respectively electrically connected to the second-end-side terminals of the power-supply cable 60 in the respective bases 43 by attaching the discharge nozzles 41 to the casing 42.

Each of the discharge electrodes 44 is made of titanium alloy, and formed into a thread-like shape having a circular cross section, and its diameter is set to 100 micrometers (0.1 millimeters) or less, for example, to 70 micrometers (0.07 millimeters). Therefore, each of the discharge electrodes 44 made of titanium alloy having relatively high hardness has flexibility and is elastically deformable, and a distal-end side of each of the discharge electrodes 44 is constituted as a free end 44*b* which can move freely in the front/rear/left/right directions. Therefore, repulsive force from the corona discharge generated by application of the high voltage causes the free end 44*b* of the discharge electrode 44 to perform a turning motion around the fixed end 44*a* so as to form an approximately conical shape in a predetermined angle range as shown by two-dot-line arrow in the drawing.

Here, the size of the turning motion of the free end 44*b*, in other words, the size of the circle formed by the free end 44*b* is determined by the rigidity of the discharge electrode 44 and the magnitude of the voltage applied to the discharge electrode 44. For example, if the discharge electrode 44 is reduced in rigidity, the discharge electrode 44 can be easily elastically deformed, and as a result, the turning motion can be increased in size. If the voltage applied to the discharge electrode 44 is increased, the size of the repulsive force from the corona discharge can be increased, and the size of the turning motion can be increased as a result.

However, when the discharge electrode 44 is composed of a further-thinned wire, or the applied voltage is further increased, the amount of the elastic deformation of the discharge electrode 44 at the time of corona discharge becomes too large, and the discharge electrode 44 may be broken. Therefore, the minimum diameter of the discharge electrode 44 and the magnitude of the voltage applied to the discharge electrode 44 are determined in consideration of the rigidity of the material (for example, titanium, tungsten, stainless steel) which forms the discharge electrode 44. In the present embodiment, titanium alloy having sufficient flexibility and rigidity and capable of suppressing the amount of dust emission to a low level is used as an optimum material.

Furthermore, since each of the discharge electrodes 44 is provided to the corresponding base 43, and its turning motion is prevented from being disturbed by contact with other discharge electrodes 44 and the like, each of the discharge electrodes 44 is elastically deformed in the same angle range in the front/rear/left/right directions to carry out turning motions. As a result, as shown in FIG. 3, the air ions EI can be caused to circularly reach delivery areas a1 each having a diameter d1 on the packaging film 10.

Next, an operation of the above ion generator 30 according to the first embodiment will be explained with reference to the drawings.

As shown in FIG. 2, when a high voltage of about 5 kilovolts is supplied to the device main body 40 from the power-supply unit 50 via the power-supply cable 60 by operating a controller (not shown), the high voltage is applied to the fixed ends 44*a* of the discharge electrodes 44. As a result, a corona discharge (not shown) is generated from the free ends 44*b* of the discharge electrodes 44.

The corona discharge is generated in irregular directions (front/rear/left/right directions) from the free ends 44*b* of the discharge electrodes 44, and repulsive force is generated in a direction opposite to the generation direction of the corona discharge. The repulsive force caused by the corona discharge bends the free end 44*b* of the discharge electrode 44 in a direction opposite to the generation direction of the corona discharge. Since the generation direction of the corona discharge is irregularly varied, the free end 44*b* of the discharge electrode 44 performs a turning motion so as to form an approximately conical shape as shown by the two-dot chain line in the drawing. Therefore, the positive air ions EI are sprayed over a wide area of the packaging film 10 from the free end 44*b* of the discharge electrode 44.

Each of the air ions EI sprayed from the free ends 44*b* of the discharge electrodes 44, each of which are performing the turning motion, forms the delivery area a1 having a diameter d1 as shown in FIG. 3. The delivery areas a1 of the discharge electrodes 44 adjacent to each other are mutually partially overlapped in the width direction of the packaging film 10 (horizontal direction in the drawing). Therefore, when the packaging film 10 is moved in the direction of the arrow "M", the entire area (shaded area in the drawing) of the electrified part along the width direction of the packaging film 10 can be electrically neutralized.

Here, the rotating speed (work feeding speed) of the roller members 21 and 22 of the film supplying apparatus 20 is set so that, when focusing on one part of the packaging film 10, it takes about two seconds for that part to pass through the delivery areas a1. In other words, the work feeding speed is set so that the static electricity of the packaging film 10 can be sufficiently eliminated.

Next, an ion generator (comparison example) provided with fixed-type discharge electrodes, each of which is not vibrated, will be explained in detail with reference to the drawings. Parts the same in function as those of the ion generator 30 according to the above first embodiment are denoted by the same reference symbols, and detail explanation thereof will be omitted.

Figure 4:
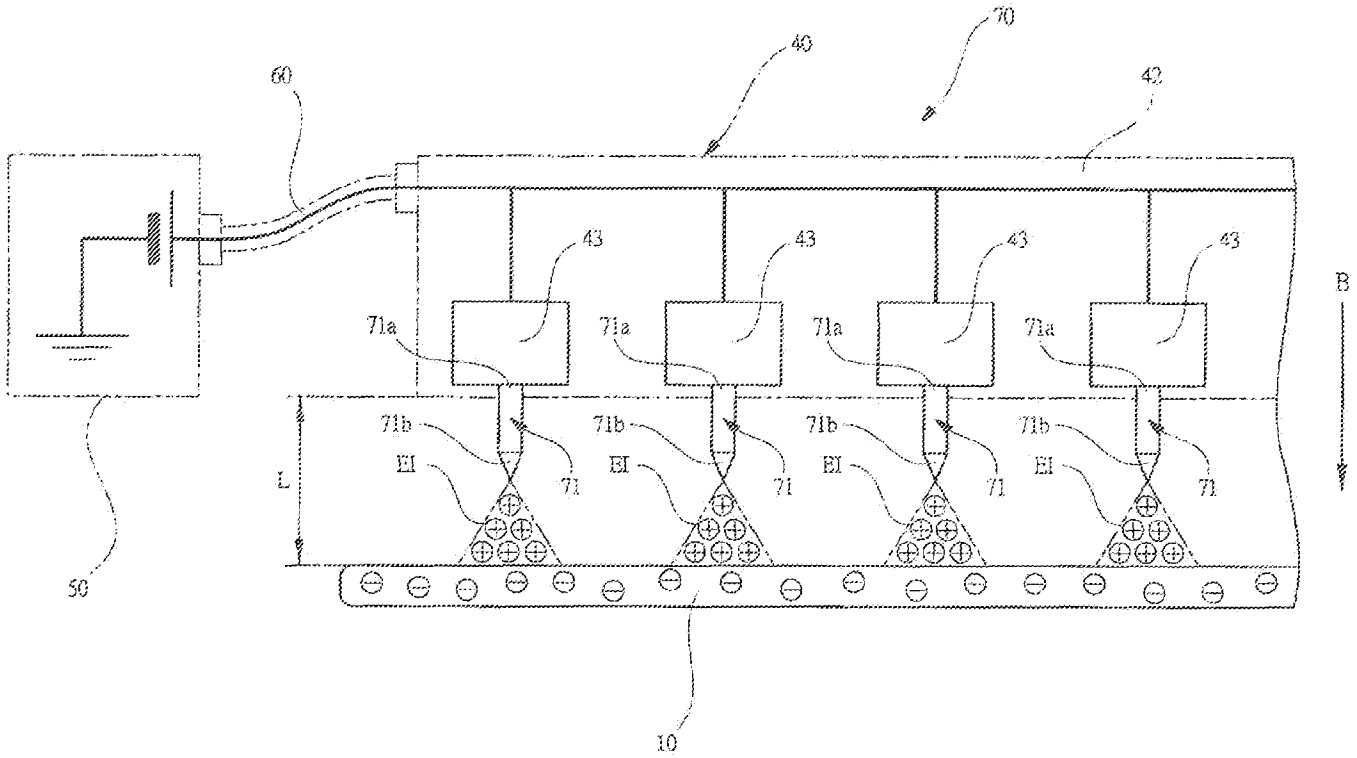
FIG. 4 Prior Art
FIG. 4 is an explanatory diagram corresponding to that of FIG. 2, and showing a comparison example of the ion generator (fixed discharge electrode specification)
Figure 5:
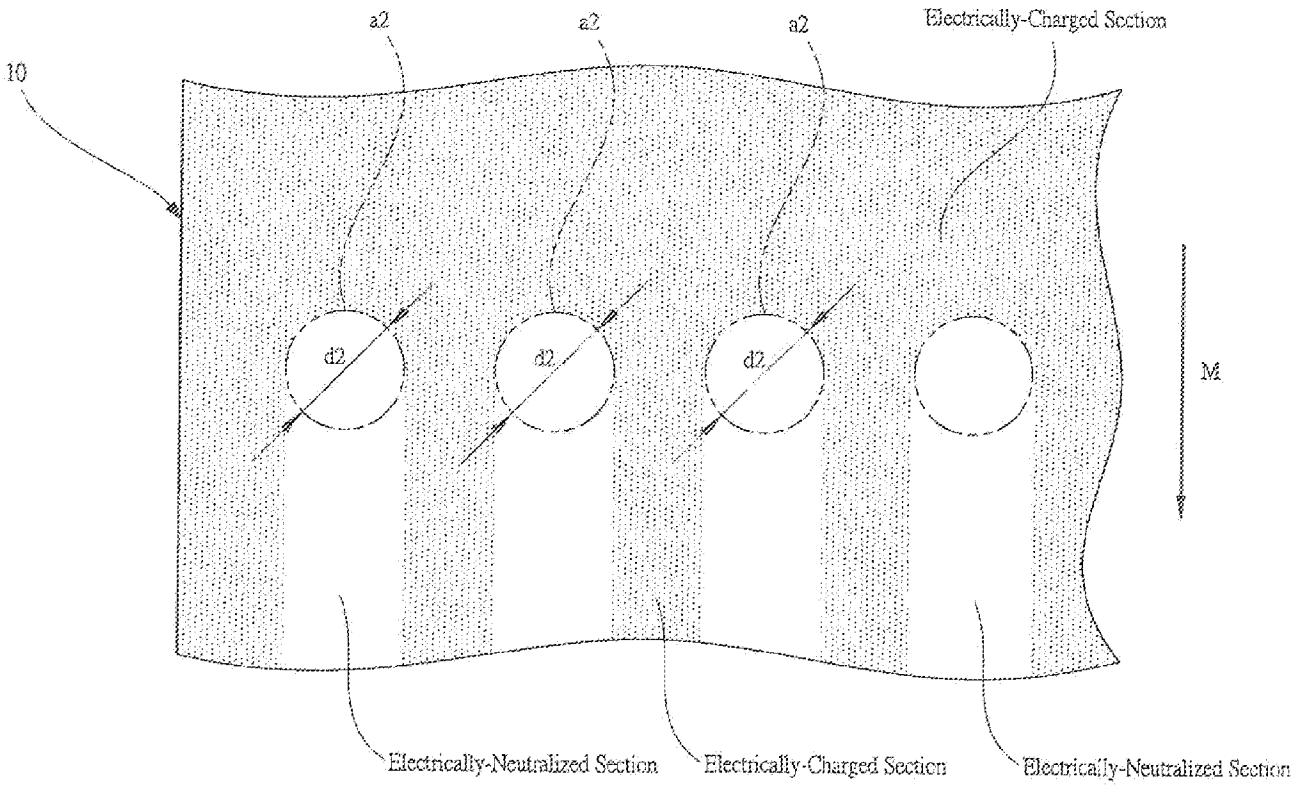
FIG. 5 Prior Art
FIG. 5 is a B-arrow diagram explaining the size of a delivery area to which air ions are carried, in the ion generator (comparison example) shown in FIG. 4.

FIG. 4 is an explanatory diagram corresponding to that of FIG. 2, and showing a comparison example of the ion generator (fixed discharge electrode specification), and FIG. 5 is a B-arrow diagram explaining the size of a delivery area to which air ions are carried, in the ion generator (comparison example) shown in FIG. 4.

In the ion generator 70 as a comparison example, fixed-type discharge needles 71, each of which is not vibrated, are fixed to respective bases 43. Each diameter of the discharge needles 71 is set to, for example, 2 millimeters, since each needle has a sufficient diameter (or rigidity), they are not elastically deformed (or vibrated) by generation of corona discharge. Fixed ends (base ends) 71*a* of the discharge needles 71 are inserted in the respective bases 43, and their distal ends 71*b* are tapered so as to easily generate a corona discharge.

Air ions EI generated at the distal end 71*b* of each of the discharge needles 71, as shown in FIG. 5, form a delivery area a2 having a diameter d2 (d2 <d1), and there is no partial overlap between the delivery areas a2 of the discharge needles 71 adjacent to each other in the width direction (horizontal direction in the drawing) of the packaging film 10. In other words, electrically-charged sections aligned along the width direction are left in the packaging film 10 passed through the ion generator 70 (device main body 40).

Here, on the assumption that the distance between the device main body 40 and the packaging film 10 is set to a value "L", the delivery area of the ion generator 30 (the present invention) shown in FIGS. 2 and 3 can be enlarged in comparison with that of the ion generator 70 (comparison example) shown in FIGS. 4 and 5 (a1>a2). In other words, in order to electrically neutralize the packaging film 10 without remaining electrically-charged section by using the apparatus of the comparison example, it is necessary to increase the distance "L" between the device main body 40 and the packaging film 10, and this distance leads to an increase in the mounting space for the ion generator. On the other hand, since the delivery area can be increased in the ion generator of the present invention, even if it is difficult to secure a sufficient mounting space for the ion generator, the delivery area can be supported (space-saving supporting type).

In the ion generator 30 according to the above first embodiment, since the flexibility discharge electrode 44 composed of one wire is provided to the base 43, and the free end 44*b* of the discharge electrode 44 is configured to perform a turning motion around the fixed end 44*a* by the repulsive force from the corona discharge which is generated when a high voltage is supplied to the fixed end 44*a* of the discharge electrode 44, in comparison with a bundle electrode composed of a plurality of thin wires, the amount of dust emission from the free end 44*b* of the discharge electrode 44 can be significantly reduced. Therefore, the ion generator 30 can be further improved in maintenance interval. Since the discharge electrode 44 is composed of a single wire, the downsized ion generator 30 can be realized, furthermore, the state of the discharge electrode 44 can be easily observed, and its maintenance can be simplified. Since the discharge electrode 44 performs the turning motion, the generated air ions EI can be transported to the wide area of the packaging film 10, and ionizing efficiency can be increased.

Furthermore, according to the ion generator 30 of the first embodiment, each of the discharge electrodes 44 is made of titanium alloy, and each diameter size is set to 70 micrometers. Therefore, for example, in comparison with tungsten alloy, the amount of dust emission can be reduced while each electrode can have high mechanical strength, and each electrode can be vibrated while having sufficient flexibility. Therefore, the ion generator 30 can be further improved in maintenance interval, and the generated air ions "EI" can be transported to a wide area.

Next, the second embodiment of the present invention will be explained in detail with reference to the drawings. Additionally, parts the same in function as those of the first embodiment are denoted by the same reference symbols, and detailed explanation thereof will be omitted.

Figure 6:
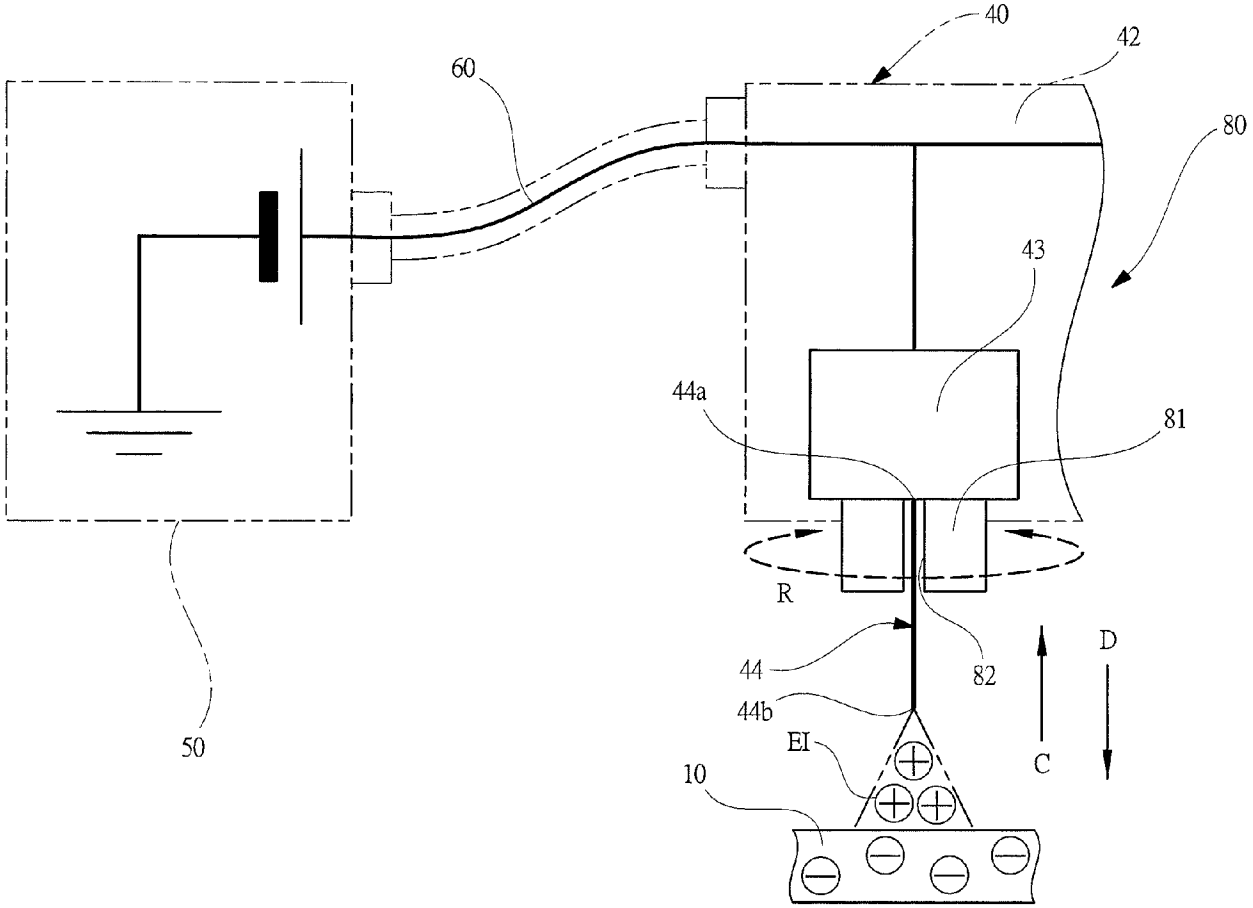
FIG. 6 is an explanatory diagram explaining the structure of the ion generator according to the second embodiment.
Figure 7A:
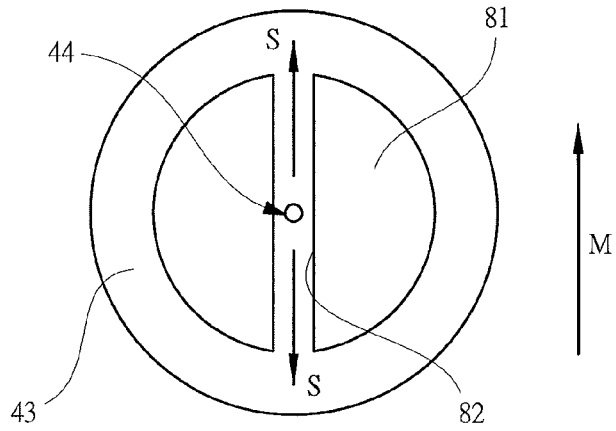
FIGS. 7A and 7B are explanatory diagrams explaining a first setup state (delivery width: small) of the ion generator shown in FIG. 6.
Figure 7B:
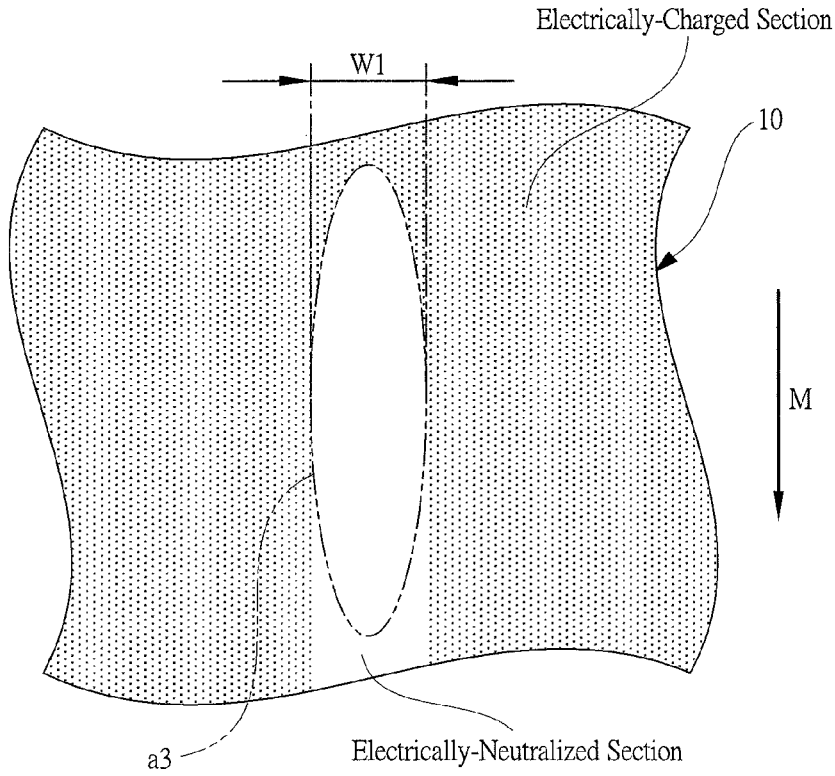
Figure 8A:
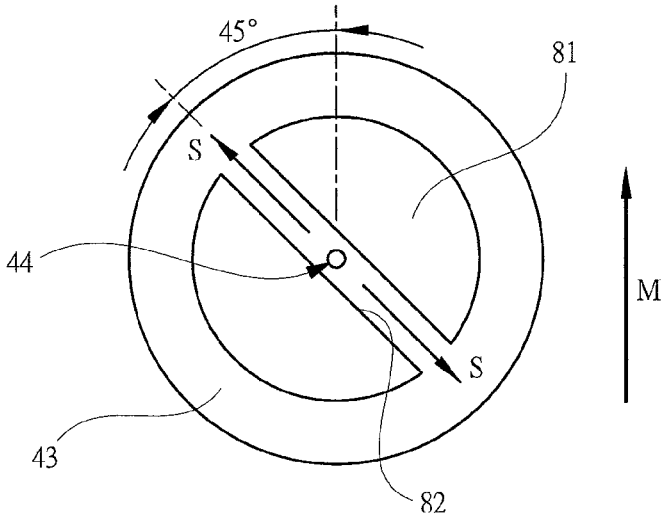
FIGS. 8A and 8B are explanatory diagrams explaining a second setup state (delivery width: middle) of the ion generator shown in FIG. 6.
Figure 8B:
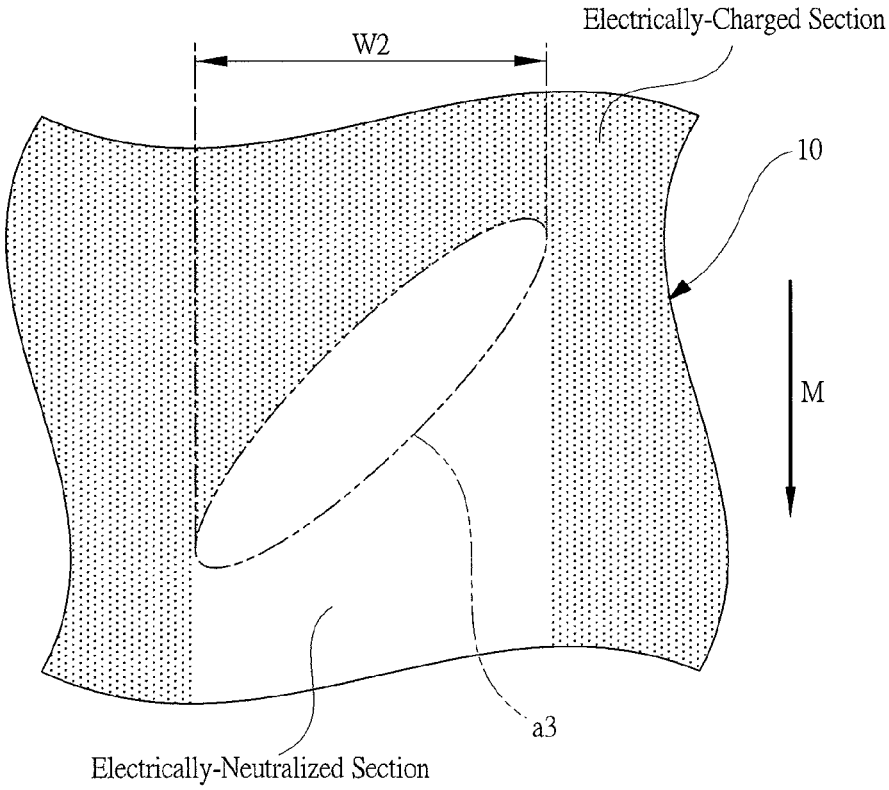
Figure 9A:
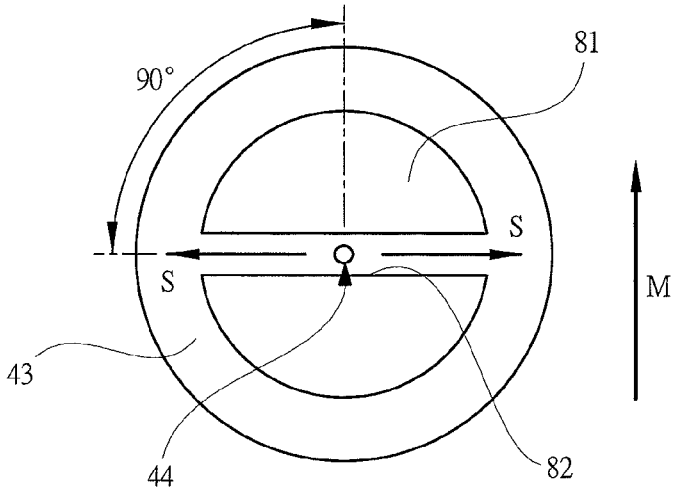
FIGS. 9A and 9B are explanatory diagrams explaining a third setup state (delivery width: large) of the ion generator shown in FIG. 6.
Figure 9B:
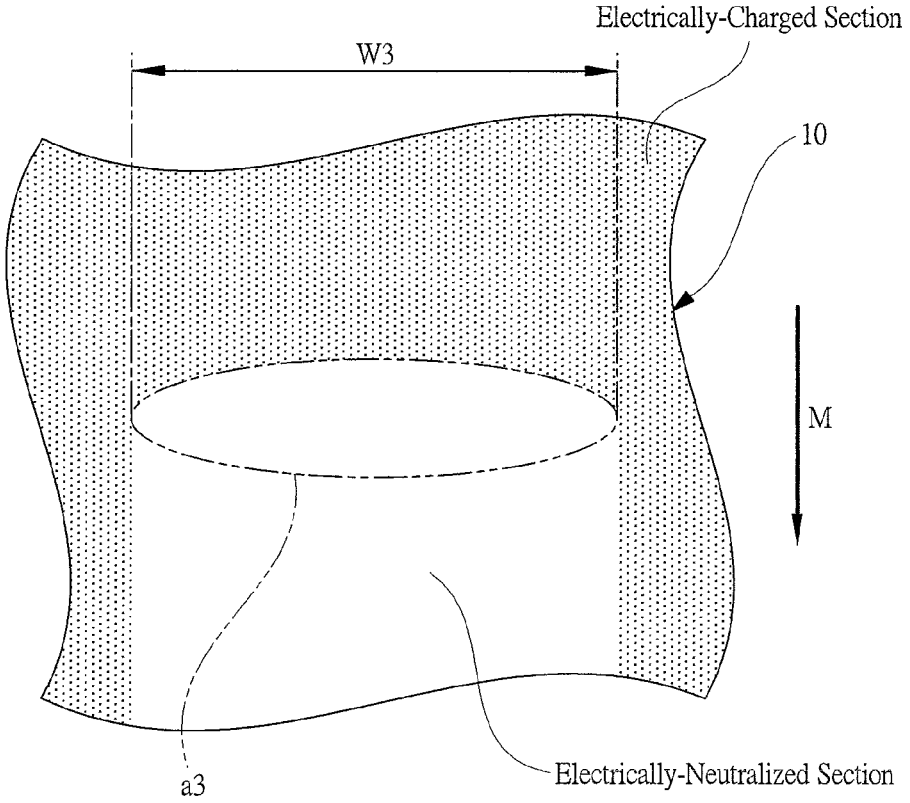

FIG. 6 is an explanatory diagram explaining the structure of the ion generator according to the second embodiment, FIGS. 7A and 7B are explanatory diagrams explaining a first setup state (delivery width: small) of the ion generator shown in FIG. 6, FIGS. 8A and 8B are explanatory diagrams explaining a second setup state (delivery width: middle) of the ion generator shown in FIG. 6, and FIGS. 9A and 9B are explanatory diagrams explaining a third setup state (delivery width: large) of the ion generator shown in FIG. 6.

As shown in FIG. 6, the ion generator 80 according to the second embodiment differs from the ion generator 30 according to the above first embodiment in that the discharge nozzle 41 (see FIG. 1) mounted on the casing 42 of the main body 40 is provided with a turning-motion control member 81 for controlling the turning motion state of the discharge electrode 41, and its delivery area of air ions EI on the packaging film 10 is adjustable in width.

The turning-motion control member 81 is formed of resin material (non-conductive material) such as for example plastic, and into an approximately cylindrical shape, and its base-end is mounted on the base 43 so as to be rotatable in the directions of broken-line arrows "R". The turning-motion control member 81 is formed with a slit 82 which extends along its axial direction from its distal end side toward its base end side, and which faces a center part of the turning-motion control member 81. The width size of the slit 82 is set to a value larger in diameter than the discharge electrode 44, for example, set to 150 to 300 micrometers, so that the turning motion of the discharge electrode 44 can be performed in the slit 82 along the formation direction of the slit 82.

FIGS. 7A, 8A, and 9A are C-arrow views of FIG. 6, since the diameter of the discharge electrode 44 differs in size from the width of the slit 82, the discharge electrode 44 is moved so as to turn in the directions of arrows "S" in the slit 82. And since the turning-motion state of the discharge electrode 44, in other words, the direction of the turning motion of the discharge electrode 44 can be controlled with respect to the moving direction of the packaging film 10 (the direction of the arrow "M") by causing the turning-motion control member 81 to rotate with respect to the base 43.

FIGS. 7B, 8B, and 9B are D-arrow views of FIG. 6, as shown in FIG. 7A, when the relative angle (adjustment angle) of the turning-motion control member 81 with respect to the base 43 is set to 0 degree to go into the first adjustment state, the discharge electrode 44 is regulated by the turning-motion control member 81 so as to perform a turning motion along the direction of the moving direction "M" of the packaging film 10. As a result, as shown in FIG. 7B, a delivery area a3 of air ions EI, which has a width W1 and an approximately elliptical shape, can be obtained (delivery width: small).

Furthermore, as shown in FIG. 8A, when the relative angle (adjustment angle) of the discharge electrode 44 regulated by the turning-motion control member 81 with respect to the base 43 is set to 45 degrees to go into the second adjustment state, the discharge electrode 44 is regulated by the turning-motion control member 81 so as to perform a turning motion in a state that the discharge electrode is shifted by 45 degrees with respect to the moving direction M of the packaging film 10. As a result, as shown in FIG. 8 (*b*), the delivery area a3 of the air ions EI which has a width W2 (W2>W1) and an approximately elliptical shape can be obtained (delivery width: medium).

Furthermore, as shown in FIG. 9A, when the relative angle (adjustment angle) of the turning-motion control member 81 with respect to the base 43 is set to 90 degrees to go into the third adjustment state, the discharge electrode 44 is regulated by the turning-motion control member 81 so as to perform a turning motion in a state where the discharge electrode is shifted by 90 degrees with respect to the moving direction "M" of the packaging film 10. As a result, as shown in FIG. 9B, the delivery area a3 of the air ions EI which has a width W3 (W3>W2) and an approximately elliptical shape can be obtained (delivery width: large).

Also in the thus-formed second embodiment, it is possible to attain the same effects as those of the above first embodiment. In addition to this, since a turning-motion control member 81 for controlling the turning-motion state of the discharge electrode 44 is provided in the second embodiment, the size, in other words, the delivery width of the delivery area a3 of the generated air ions EI can be arbitrarily controlled in accordance with, for example, the shape of the packaging film 10 or another object to be electrically neutralized.

Next, the third embodiment of the present invention will be explained in detail with reference to the drawings. Additionally, parts the same in function as those of the above first embodiment are denoted by the same reference symbols, and detail explanation thereof will be omitted.

Figure 10:
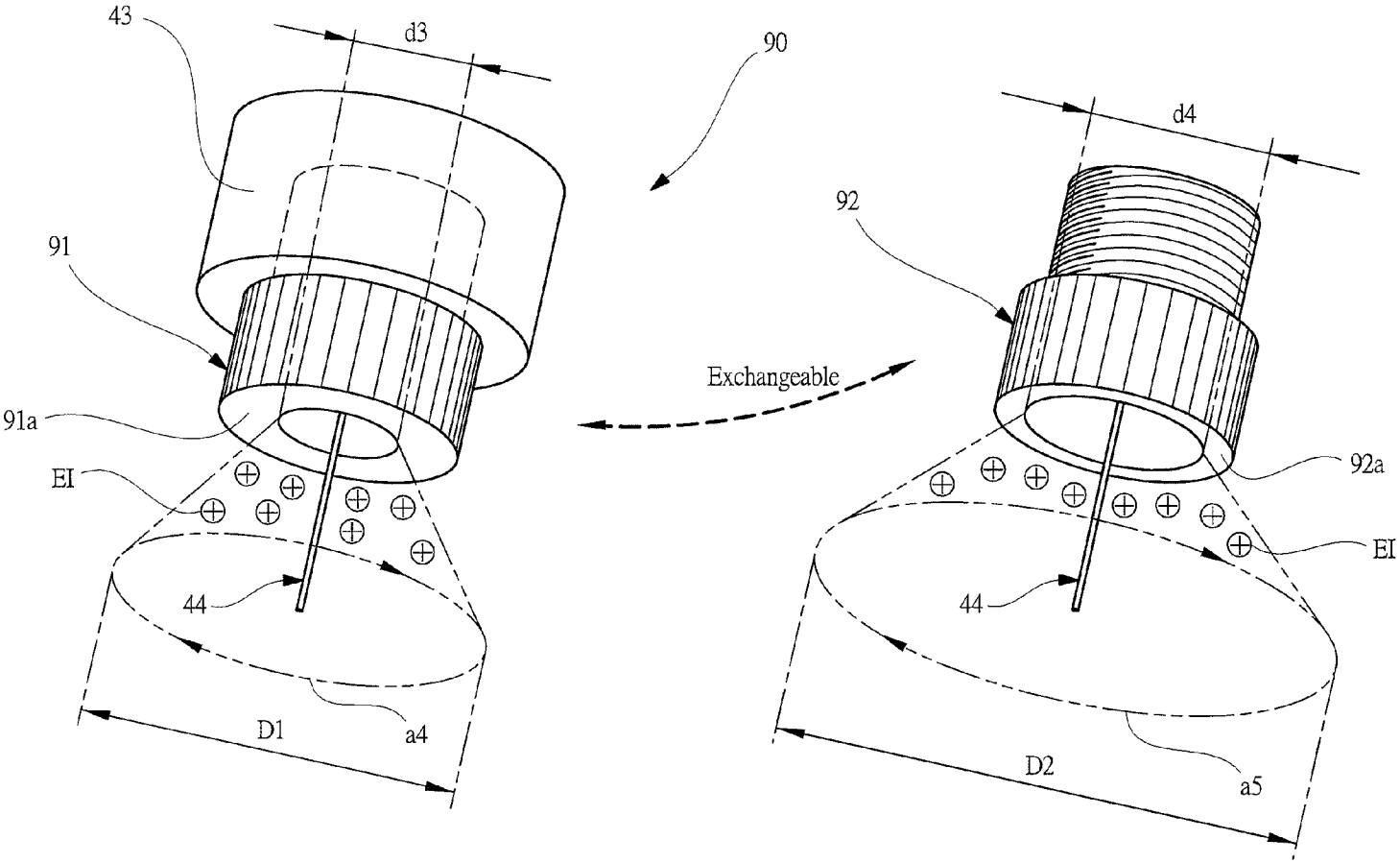
FIG. 10 is an explanatory diagram explaining a main section of the ion generator according to the third embodiment.

FIG. 10 is an explanatory diagram explaining a main section of the ion generator according to the third embodiment.

As shown in FIG. 10, the ion generator 90 according to the third embodiment differs from the ion generator 30 according to the above first embodiment in that a replaceable discharge-electrode unit 91 is provided to the discharge nozzle 41 (see FIG. 1) mounted on the casing 42 of the main body 40, and this replaceable discharge-electrode unit 91 can be attached to the base 43 in the detachable manner, and can be replaced with another replaceable discharge-electrode unit 92 based on another specification.

The replaceable discharge-electrode unit 91 is formed of resin material (non-conductive material) such as for example plastic, and into a cylindrical shape, and the replaceable discharge-electrode unit 91 is provided with a turning-motion control cylindrical part 91*a* of which inner-diameter size is set to d3. The turning-motion control cylindrical part 91*a* is configured to regulate the diameter size of the delivery area a4 of the air ions EI, which are transported by the discharge electrode 44, to D1.

The replaceable discharge-electrode unit 92 is formed of resin material (non-conductive material) such as for example plastic, and into a cylindrical shape, and the replaceable discharge-electrode unit 92 is provided with a turning-motion control cylindrical part 92*a*, and its inner-diameter is set to a value d4 (d4>d3). The turning-motion control cylindrical part 92*a* is configured to regulate the diameter size of the delivery area a5 of the air ions EI, which are transported by the discharge electrode 44, to D2 (D2>D1).

In this case, each of the turning-motion control cylindrical parts 91*a* and 92*a* constitutes a turning-motion control member in the present invention.

Also in the above third embodiment, the same effects as those of the above first embodiment can be exerted. In addition to this, since the discharge nozzle 41 is provided with a replaceable discharge-electrode unit 91, which is exchangeable, in the third embodiment, in accordance with the shape or the like of the packaging film 10 or another object to be electrically neutralized, it is possible to replace the attached replaceable discharge-electrode unit 91 with the replaceable discharge-electrode unit 92 having another different specifications.

Next, the fourth to sixth embodiments of the present invention will be explained in detail with reference to the drawings. Additionally, parts the same in function as those of the above first embodiment are denoted by the same reference symbols, and detail explanation thereof will be omitted.

Figure 11A:
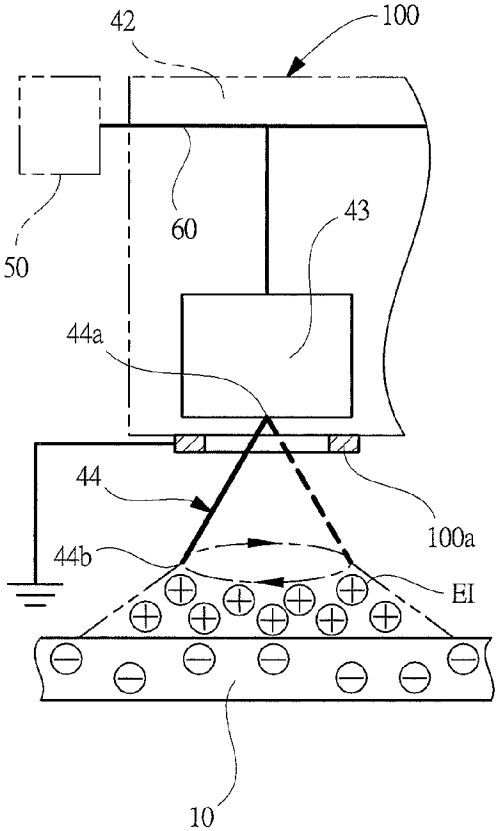
FIGS. 11A, 11B, and 11C are explanatory diagrams respectively explaining the structures of the ion generators according to fourth to sixth embodiments.
Figure 11B:
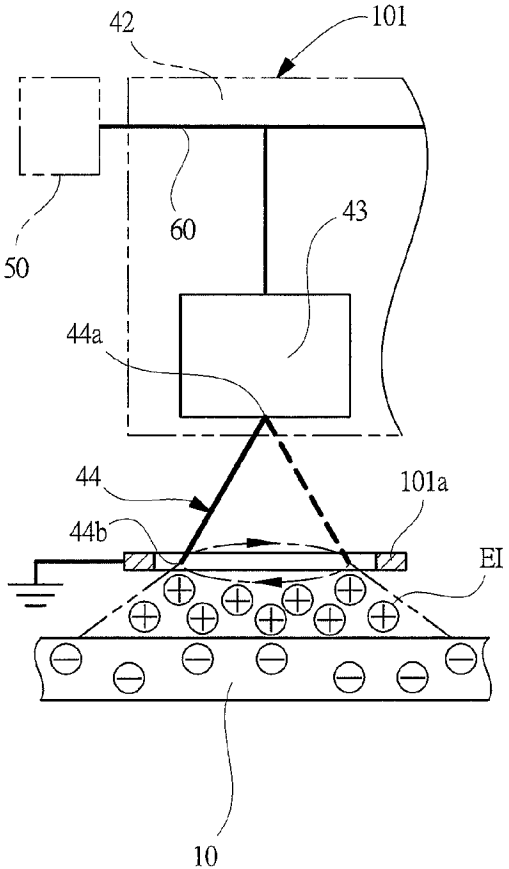
Figure 11C:
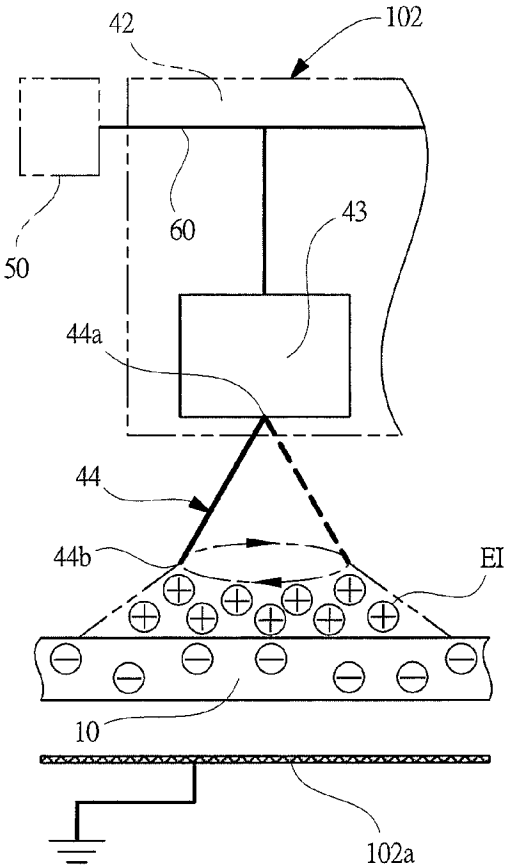

FIGS. 11A, 11B, and 11C are explanatory diagrams respectively explaining the structures of the ion generators according to fourth to sixth embodiments.

As shown in FIGS. 11A, 11B, and 11C, each of the ion generators 100 to 102 according to the fourth to sixth embodiments differs from the ion generator 30 according to the above first embodiment in that electrically-grounded opposite electrodes 100*a* to 102*a* made of metal are located around the respective discharge electrodes 44 or respective opposite portions of the free ends 44*b* of the discharge electrodes 44.

As shown in FIG. 11A, the ion generator 100 according to the fourth embodiment is provided with an annular opposite electrode 100*a* which is arranged in a circular pattern so as to ring the same side of the discharge electrode 44 as the fixed end 44*a*. By virtue of this configuration, the generation direction of the corona discharge from the discharge electrode 44 can be directed to the opposite electrode 100*a*, and as a result, it is possible to increase the angle range of the turning motion of the discharge electrode 44. Therefore, it is possible to attain the same effects as those of the first embodiment, and to further increase the delivery area of the air ions EI with respect to the packaging film 10.

As shown in FIG. 11B, the ion generator 101 according to the fifth embodiment is provided with an annular opposite electrode 101*a* which is arranged in a circular pattern so as to ring the same side of the discharge electrode 44 as the free end 44*b*. By virtue of this configuration, the generation direction of the corona discharge from the discharge electrode 44 can be directed to the opposite electrode 101*a*, and as a result, it is possible to cause the free end 44*b* of the discharge electrode 44 to stably perform the turning motion along the inner periphery of the opposite electrode 101*a*. Therefore, it is possible to attain the same effects as those of the first embodiment, and to further increase the delivery area of the air ions EI with respect to the packaging film 10.

As shown in FIG. 11C, the ion generator 102 according to the sixth embodiment is provided with a mesh-like (net-like) or a plate-like opposite electrode 102*a* located on the far side of the packaging film 10. As a result, the generation direction of the corona discharge from the discharge electrode 44 can be reliably directed to the packaging film 10.

As explained above, the ion generators 100 to 102 according to the fourth to sixth embodiments can attain the same effects as those of the first embodiment, and since they are provided with opposite electrodes 100*a* to 102*a*, it is possible to guide the generation direction of the corona discharge, and to generate the corona discharge from the discharge electrode 44 even at a low voltage. Therefore, it is possible to further reduce the amount of dust emission from the discharge electrode 44, and to save electric power which is used in the ion generator. Furthermore, since the generation direction of the corona discharge is guided and directed to the packaging film 10 so that the air ions EI can be efficiently transported, the electrical-neutralization time of the packaging film 10 can be further shortened (electrical-neutralization efficiency can be further improved). Therefore, the feeding speed of the packaging film 10 can be increased, and the film supplying apparatus 20 can be enhanced in efficiency.

The present invention is not limited to the above embodiments, and it goes without saying that various modifications can be made within the range not departing from the gist thereof. For example, the above embodiments show the cases in which each of the discharge electrodes 44 is made of titanium alloy. However, the present invention is not limited to this material, and a discharge electrode made of another material such as for example tungsten and stainless steel may be employed on the basis of the electrical-neutralization performance (specification) and the like of the ion generator.

In the above embodiments, the short distance between the discharge electrode 44 and the packaging film 10 causes the air ions EI to reach the packaging film 10. However, the present invention is not limited to this, and an air supply source may be connected to the ion generator, and the air ions EI may be sprayed from the discharge nozzles 41 toward the packaging film 10 together with supplied air.

Furthermore, in the above embodiments, the positive air ions "EI" are generated by the discharge electrodes 44. However, the present invention is not limited to the above embodiments. Based on the electrically-charged state (positive/negative) of the object to be electrically neutralized, negative air ions EI can be generated by the discharge electrodes 44, or positive or negative air ions EI can be alternately generated by the discharge electrodes 44.

Industrial Applicability

The ion generator is used for electrically neutralizing and eliminating static electricity from for example a jig for assembling electronic parts, a packaging film composed of a plastic material, and the like.

What is claimed is:

1. An ion generator comprising:

a base;

a flexible discharge electrode which is composed of one wire, one end of the discharge electrode serving as a free end, and the other end of the discharge electrode is defined as a fixed end; and a turning-motion control member having a through hole extending along an axial direction of the control member, wherein the fixed end of the discharge electrode is inserted into the through hole, and fixed to the base, wherein a turning motion of the free end about the fixed end is performed by repulsive force of corona discharge generated by supplying a high voltage to the fixed end, and the turning-motion control member regulates an amplitude of the turning motion by engaging with the discharge electrode.

2. The ion generator according to claim 1, wherein the discharge electrode is set to 100 micrometers or less in diameter size.

3. The ion generator according to claim 1, wherein the discharge electrode is formed of titanium alloy.

4. An ion generator comprising:

a base;

a flexible discharge electrode which is composed of one wire, one end of the discharge electrode serving as a free end, and the other end of the discharge electrode is defined as a fixed end; and a turning-motion control member having a slit extending along an axial direction of the control member, wherein the fixed end of the discharge electrode is inserted into the slit along the axial direction of the control member, and fixed to the base, when a turning motion of the free end about the fixed end is performed by repulsive force of corona discharge generated by supplying a high voltage to the fixed end, the turning-motion control member regulates an amplitude of the turning motion by engaging with the discharge electrode.

5. The ion generator according to claim 4, wherein the discharge electrode is set to 100 micrometers or less in diameter size.

6. The ion generator according to claim 4, wherein the discharge electrode is formed of titanium alloy.

* * * * *